US005980430A

United States Patent [19]

Wang

[11] Patent Number: 5,980,430

[45] Date of Patent: Nov. 9, 1999

[54] TREAD BOARD FOR TREADERS

[76] Inventor: Chin-Yi Wang, P.O. Box 82-144, Taipei, Taiwan

[21] Appl. No.: 08/995,910

[22] Filed: Dec. 22, 1997

[51] Int. Cl.[6] ..... A63B 21/00

[52] U.S. Cl. ..... 482/54; 482/51

[58] Field of Search ..... 482/51, 54, 142

[56] References Cited

U.S. PATENT DOCUMENTS 4,614,337 9/1986 Schonenberger ..... 482/54

*Primary Examiner*—Glenn E. Richman
*Attorney, Agent, or Firm*—A & J

[57] ABSTRACT

A tread board for a treader includes a base board, an elastic layer disposed on top of the base board, a laminate layer disposed on top of the elastic layer, and a surface layer of a smooth surface disposed on top of the laminate layer. The elastic layer provides a buffering function to reduce impact on the user's feet, making the treader safe and comfortable to use. The smooth surface of the surface layer reduces friction between the tread belt and the surface layer and reduces the load of the motor, thereby prolonging the useful life of the tread belt and the motor.

1 Claim, 2 Drawing Sheets

TREAD BOARD FOR TREADERS

BACKGROUND OF THE INVENTION

1. Field of the Invention

The present invention relates generally to a tread board for a treader, and more particularly to a tread board that is safe and comfortable to use and that prolongs the life of the tread belt and the motor of the treader.

2. Description of the Prior Art

FIG. 1 shows an elevational view of an ordinary treader. A tread board is disposed at the bottom end of the treader. The "tread board" used herein refers to the board which is surrounded by the tread belt on the upper and lower sides thereof and on which users tread. The conventional tread board is usually hard and non-elastic. When a user runs on the tread board, his/her feet may easily hurt or twist as the direct impact on the feet when they touch the hard tread board is great.

SUMMARY OF THE INVENTION

The present invention relates generally to a tread board for a treader, and more particularly to a tread board that is safe and comfortable to use and that prolongs the life of the tread belt and the motor of the treader.

It is therefore a primary object of the present invention to provide a tread board for treaders that is safe to use, in which the tread board includes a base board and an elastic layer disposed on top of the base board to provide a buffering effect. The elastic layer absorbs any shock or direct impact on the user's feet to avoid possible twisting of the feet or spraining of the ankles.

Another object of the present invention is to provide a tread board for treaders that is comfortable to use, in which the tread board includes a base board and an elastic layer disposed on top of the base board. The elasticity of the elastic layer reduces the counter force on the user's feet when they touch the tread board so that the user's feet will not easily become sore.

A further object of the present invention is to provide a tread board for treaders to prolong the useful life of the tread belt and the motor, in which the tread board includes a laminate layer and a surface layer of a very smooth surface disposed on top of the laminate layer. The smoothness of the surface layer reduces the friction between the surface layer and the tread belt and reduces the load on the motor, thereby enhancing the life of the tread belt and the motor.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
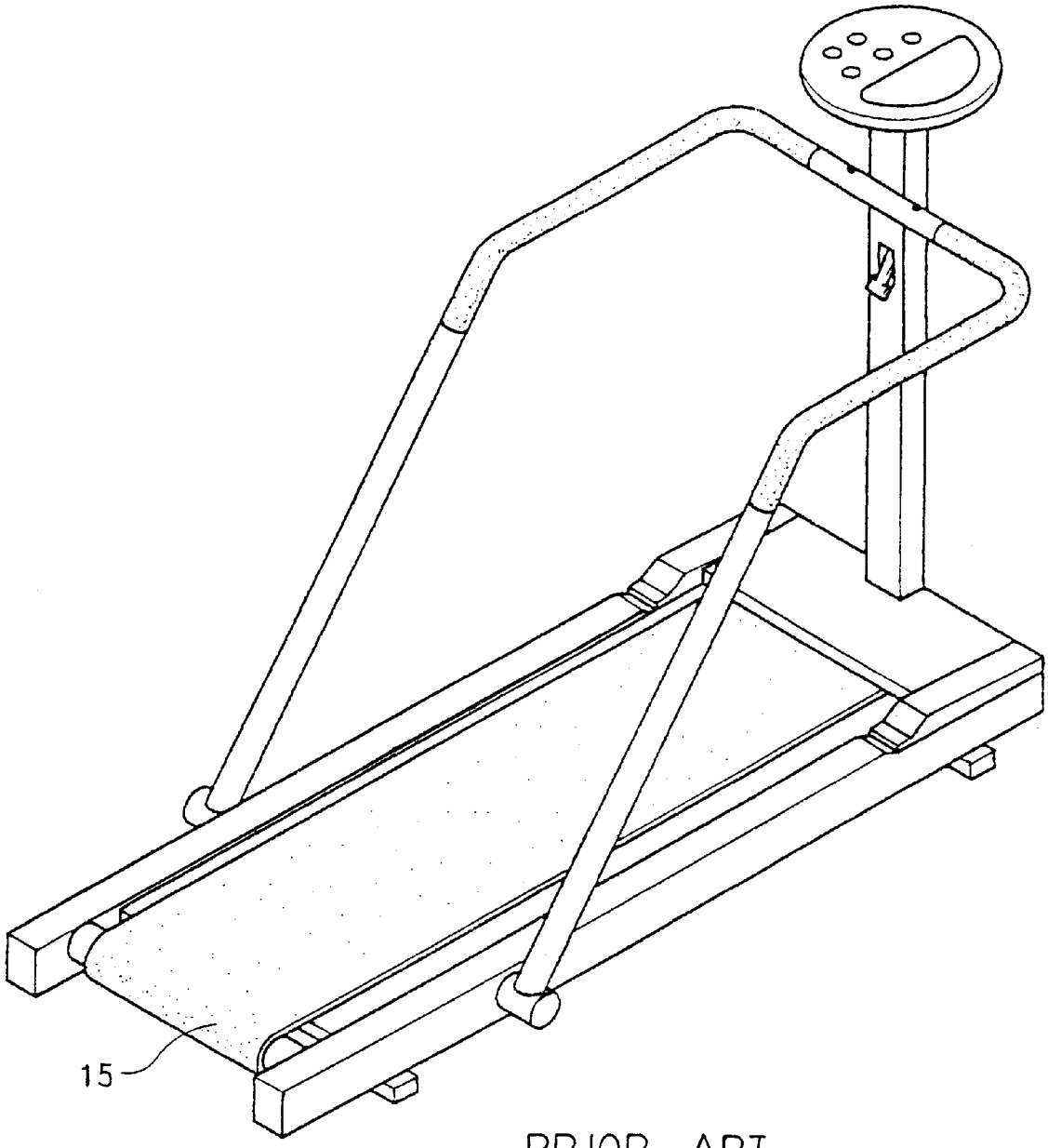
PRIOR ART FIG. 1
FIG. 1 is a perspective view of a conventional treader.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
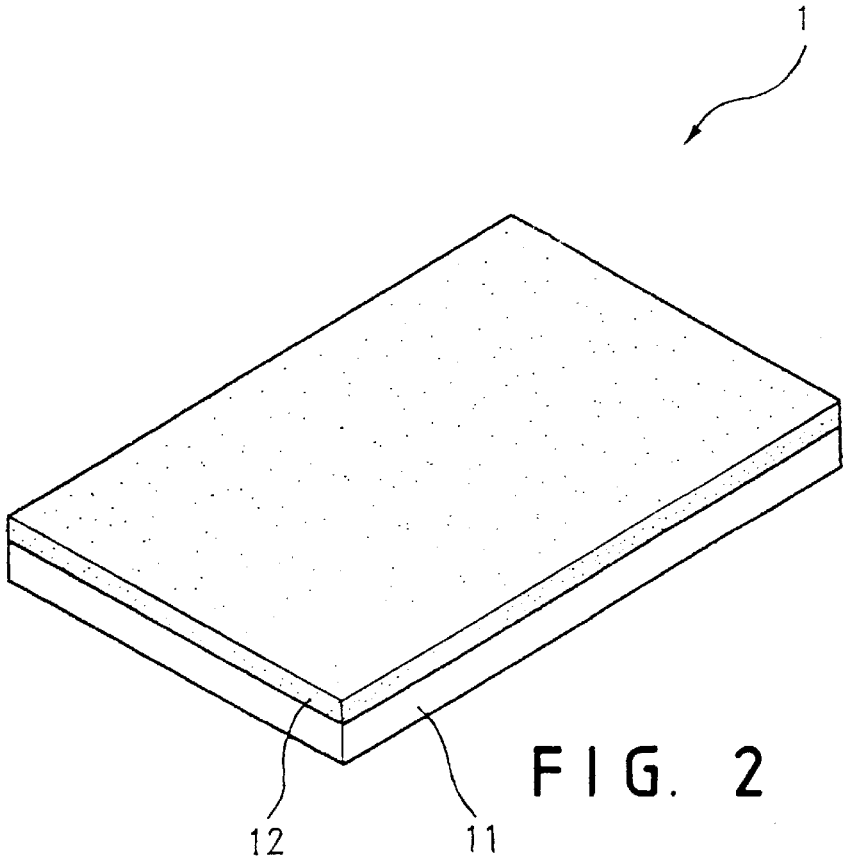
FIG. 2 is a perspective view of an embodiment of the present invention.

With reference to FIG. 2, the present invention comprises a base board 11, and an elastic layer 12.

The base board 11 is located at a bottom end of the treader. The elastic layer 12 may just be spread out on the surface of the base board 11.

The elastic layer 12 is disposed on the upper surface of the base board 11 and is a plate structure made of elastic material. Due to its elasticity, the elastic layer 12 provides a buffering effect when a user steps on the treader.

Figure 3:
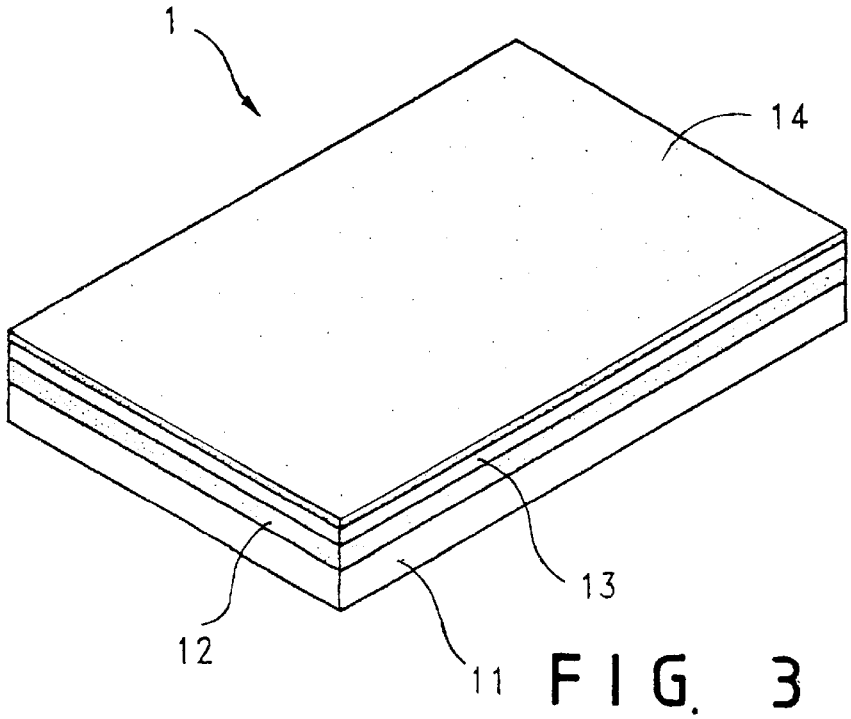
FIG. 3 is a perspective view of another embodiment of the present invention.

With reference to FIG. 3, a laminate layer 13 may be disposed on the elastic layer 12, and a surface layer 14 may be disposed on top the laminate layer 13.

The laminate layer 13 is a plate structure and has an upper surface on which the surface layer 14 may just be disposed. The laminate layer 13 is made of relatively hard material for supporting the surface layer 14 to prevent it from cracking.

The surface layer 14 is a laminate of brittle nature but having a very smooth surface. In generally, it is a PC board. The very smooth surface of the surface layer 14 reduces the friction between a tread belt 15 and the surface layer 14, thereby reducing the load of the motor and prolonging the useful life of the tread belt 15 and the motor.

The treader according to the present invention has the following advantages:

1. The present invention is safe to use. As the elastic layer 12 provides a suitable buffering effect, the user may not easily twist or sprain his/her feet when using the treader.
2. The present invention is comfortable to use. As the elastic layer 12 is disposed on top of the base board 11 on the tread board 1, when the user runs on the tread board, the elasticity of the elastic layer 12 reduces the counter-force generated when the feet touch the tread board 1, making it very comfortable to use the treader.
3. The useful life of the treader is prolonged. As the tread board 1 has the laminate layer 13 and a surface layer 14 disposed thereon, the very smooth surface of the surface layer 14 reduces the friction between the tread belt 15 and the surface layer 14 so that that load of the motor is decreased. The life of the tread belt 15 and the motor may thus be enhanced.

In summary, the present invention comprises a base board having disposed thereon in sequence a buffering elastic layer, a laminate layer, and a very smooth surface layer and provides the above-mentioned advantages.

Although the present invention has been illustrated and described with reference to the preferred embodiment thereof, it should be understood that it is in no way limited to the details of such embodiment but is capable of numerous modifications within the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A tread board for treaders, comprising a base board disposed at a bottom end of the treader, and an elastic layer disposed on an upper side of said base board, wherein said elastic layer is a plate structure made of elastic material and an laminate layer is disposed on said elastic layer, with a very smooth surface layer disposed on said laminate layer.

* * * * *